US010836566B2

(12) United States Patent
Bisio

(10) Patent No.: US 10,836,566 B2
(45) Date of Patent: Nov. 17, 2020

(54) SINGLE-DOSE CAPSULE FOR THE PREPARATION OF BEVERAGES

(71) Applicant: BISIO PROGETTI S.P.A., Alessandria (IT)

(72) Inventor: Stefano Bisio, Alessandria (IT)

(73) Assignee: Bisio Progetti S.p.A., Alessandria (IT)

( * ) Notice: Subject to any disclaimer, the term of this patent is extended or adjusted under 35 U.S.C. 154(b) by 259 days.

(21) Appl. No.: 15/739,980

(22) PCT Filed: Jun. 24, 2016

(86) PCT No.: PCT/IB2016/053772
§ 371 (c)(1),
(2) Date: Dec. 26, 2017

(87) PCT Pub. No.: WO2016/207845
PCT Pub. Date: Dec. 29, 2016

(65) Prior Publication Data

US 2018/0194545 A1 Jul. 12, 2018

(30) Foreign Application Priority Data

Jun. 26, 2015 (IT) ..... 102015000028036

(51) Int. Cl.
*B65D 85/80* (2006.01)
*B65D 85/804* (2006.01)

(52) U.S. Cl.
CPC ..... *B65D 85/8043* (2013.01)

(58) Field of Classification Search
CPC ..... B65D 85/804; B65D 85/8043; B65D 85/8046; B65D 85/8064
See application file for complete search history.

(56) References Cited

U.S. PATENT DOCUMENTS

2011/0185910 A1* 8/2011 Ryser ..... B65D 85/8043 99/295
2015/0208852 A1* 7/2015 Doglioni Majer ..... B65D 85/8043 99/295
2015/0353274 A1* 12/2015 Bisio ..... B65D 85/8043 277/312
2016/0039601 A1* 2/2016 Doglioni Majer .... A47J 31/407 99/295

FOREIGN PATENT DOCUMENTS

WO 2013157924 A1 10/2013
WO 2014001584 A1 1/2014
(Continued)

OTHER PUBLICATIONS

International Search Report in PCT/IB2016/053772 dated Sep. 8, 2016.

(Continued)

*Primary Examiner* — Bayan Salone

(74) *Attorney, Agent, or Firm* — Henry J. Cittone; Cittone Demers & Arneri LLP

(57) ABSTRACT

A single-dose capsule for the preparation of a beverage comprises a cup (1) with a collar (10) provided with a sealing ring (20) surrounded internally and externally by centring projections (30.*i*, 40.*i*), separated circumferentially from gaps (32,42) and arranged aligned in succession along respective circumferential paths (34, 44).

12 Claims, 12 Drawing Sheets

(56) References Cited

FOREIGN PATENT DOCUMENTS

| | | | | | |
|---|---|---|---|---|---|
| WO | 2014012783 | A2 | | 1/2014 | |
| WO | 2014017698 | | * | 1/2014 | ..... A47J 31/3633 |
| WO | 2014118812 | A1 | | 8/2014 | |
| WO | 2014167526 | A1 | | 10/2014 | |

OTHER PUBLICATIONS

Written Opinion of the International Searching Authority in PCT/IB2016/053772 dated Sep. 8, 2016.

* cited by examiner

SINGLE-DOSE CAPSULE FOR THE PREPARATION OF BEVERAGES

This invention relates to a single-dose capsule for the preparation of coffee, infusions, decoctions or other hot or cold beverages.

These capsules are constituted by a cup made of aluminium or plastic material, intended to contain a food preparation, usually in powder, closed by a film. The cup is provided with a collar.

For the preparation of the beverage, the capsule is inserted in a compartment of a machine and, by means of appropriate movements of its components, the front surface of the collar goes in abutment against a fixed wall of the compartment, while the rear surface engages with the edge peripheral of an inner chamber of the machine so as to form a seal.

The passage or permanence of a food liquid through the capsule, typically hot water, allows obtaining the beverage.

Obtaining a reliable seal is one of the major problems in the specific sector, as also evidenced by the large number of patent documents on the subject. The same Applicant has developed a highly efficient sealing system, illustrated in International Application WO 2014/118812 A1.

In the context of this problem, one of the most important requirements is the need to ensure a seal even when the capsule, before being engaged between the fixed wall and the peripheral edge of the machine, is misaligned.

In fact, the fact capsule is manually inserted in the compartment of the machine and is typically allowed to fall inside it. Therefore, due to the necessary play between the walls of the chamber and the capsule and the inevitable constructional tolerances of the capsule and of the different machines, it is possible that the collar is not perfectly coaxial with the peripheral edge.

This circumstance sometimes results in a non-optimal seal that leads to hot water leaking from the inner chamber that, depending on the constructional characteristics of the machine, pours into a drain compartment of the machine or into the cup prepared for the collection of the beverage.

In both cases, the user is immediately aware of the malfunction.

The purpose of this invention is to realise a capsule that overcomes the drawbacks mentioned.

This purpose is realised by a capsule according to claim 1. The dependent claims describe variant embodiments.

The characteristics and the advantages of the capsule according to this invention will be apparent from the following description, given by way of non-limiting example, in accordance with the accompanying figures, in which.

Figure 1:
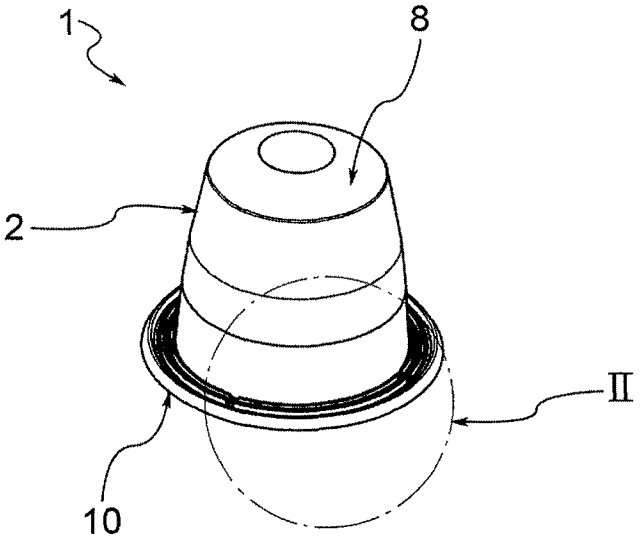
FIGS. 1, 5, 9 and 13 show a capsule according to embodiments of this invention.

With reference to the accompanying figures, 1 indicates, in its entirety, a cup of a single-dose capsule for the preparation of a beverage, for example coffee, an infusion, a decoction and the like.

The cup 1 is intended to contain a food preparation and comprises a cup wall 2, which extends in height along a central axis X, between a rear end 4 and an opposite front end 6.

The cup 1 also comprises a cup bottom 8 that closes the cup wall 2 in correspondence of the rear end 4 so as to prevent leakage of the preparation for the beverage.

The bottom 8 is intended to be traversed by the liquid for the preparation of the beverage, typically hot water or another food liquid, such as milk.

For this purpose, according to an embodiment variant, the bottom has weakening portions suitable to tear when the capsule is in use, so as to form passages for the liquid towards the inside of the cup.

According to a further embodiment, the bottom, when still intact, is realised by at least one porous portion, by itself traversable by the liquid.

In correspondence of the front end 6, the cup 1 comprises a collar 10, typically arranged at the free end of the cup wall 2, projecting radially outwardly.

Preferably, the cup wall 2 presents externally a substantially frustoconical shape overall, for example realised by the succession of frustoconical surfaces having different angular openings.

For example, the cup wall 2 presents a first frustoconical outer region 2*a*, connected to the collar 10, having a first angular opening, then, alongside the first outer region 2*a*, a second frustoconical outer region 2*b* having a second angular opening greater than the first and, finally, alongside the second outer region 2*b*, a third frustoconical outer region 2*c*, having a third angular opening greater than the second. The cup bottom 8 is placed alongside the third outer region 2*c*.

The collar 10 presents a front face 10*a* facing towards the opening of the cup 1 and an opposite rear face 10*b*, intended to engage with an annular peripheral edge of the inner chamber of the machine.

The front face 10*a* of the collar 10 is intended for the union, with the annular peripheral region, of a film of the capsule, which closes the cup at the front end.

According to a preferred embodiment, the front face 10*a* is provided with one or more concentric grooves 12*a*,12*b*, 12*c*, for example, continuous and concentric, suitable to ensure a desired flexibility of the collar 10 and to ensure the connection, for example via heat-sealing, with the film.

According to a further embodiment, the front face 10*a* is flat and therefore without grooves.

The rear face 10*b* preferably presents an annular cavity 14 between an annular peripheral wall 16 of the collar 10 and the cup wall 2.

Arranged on the rear face 10*b* of the collar 10, the cup 1 comprises at least one sealing ring 20 that extends circumferentially in a continuous manner, intended to sealingly engage with the peripheral edge of the inner chamber of the machine.

In other words, the sealing ring is intended to realise a sealing head with the peripheral edge of the inner chamber.

Preferably, the sealing ring 20 has a tapered cross section, preferably terminating in an apex, so as to assume a generally triangular shape.

According to a further embodiment (not shown), a plurality of concentric sealing rings is provided.

Preferably, said sealing rings are made of the same material as the collar and, preferably, integral with the collar.

Due to the characteristics of the material and structural and dimensional characteristics, the sealing ring is deformable under the compression action of the peripheral edge of the machine, so as to realise the seal; typically, given the compression action of the edge of the heating of the ring material during use of the capsule, the deformation is of the plastic type.

According to further embodiment variants (not shown), the sealing rings are made of different material from that of the collar, for example by co-moulding or formed separately from the collar and then applied to it.

The cup according to this invention also comprises centring means, provided on the rear face 10*b* of the collar 10, suitable to interact with the peripheral edge of the inner compartment of the machine to change the arrangement of the capsule with respect to said peripheral edge, improving the centring of the collar.

According to a preferred embodiment, said centring means comprise a plurality of external centring projections 30.*i* (i=1, 2, . . . , n), arranged radially externally with respect to the sealing ring 20, circumferentially separated by an external gap 32.

Each external projection 30.*i* presents a circumferential trend and all together are arranged aligned in succession along a single external circumferential path 34.

Preferably, each external centring projection 30.*i* has an inclined external invitation surface 36 facing towards the sealing ring 20.

In addition, preferably, each external centring projection 30.*i* has a height equal to, or greater than, that of the sealing ring 20.

In addition, preferably, said centring means comprise a plurality of internal centring projections 40.*i* (i=1, 2, . . . , n), arranged radially externally with respect to the sealing ring 20, circumferentially separated by an internal gap 42.

Each internal projection 40.*i* presents a circumferential trend and all together are arranged aligned in succession along a single internal circumferential path 44.

Preferably, each external projection 40.*i* has an internal inclined invitation surface 46 facing towards the sealing ring 20.

In addition, preferably, each internal projection 40.*i* has a height equal to, or greater than, that of the sealing ring 20.

Figure 2:
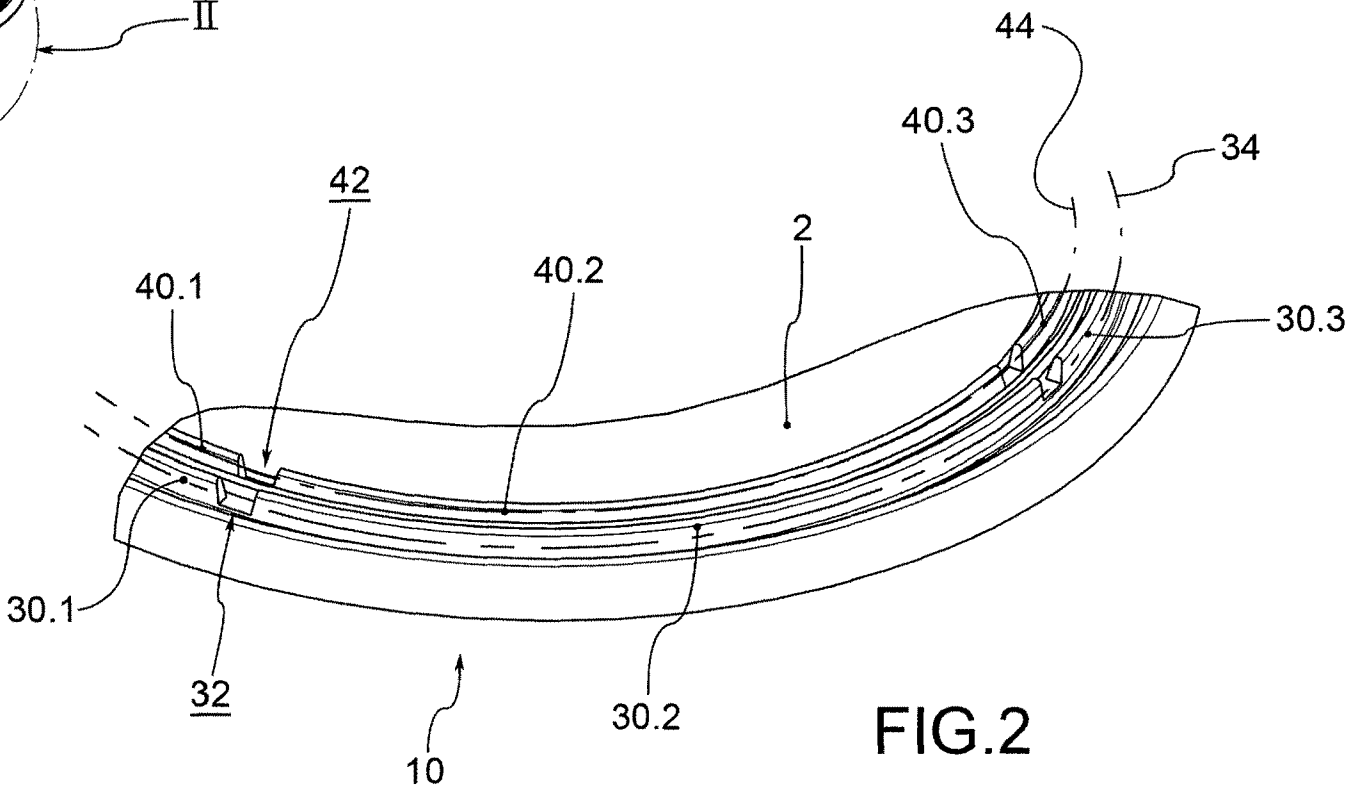
FIGS. 2, 6, 10 and 14 represent an enlargement of details II, VI, X and XIV respectively of FIGS. 1, 5, 9 and 13.
Figure 3:
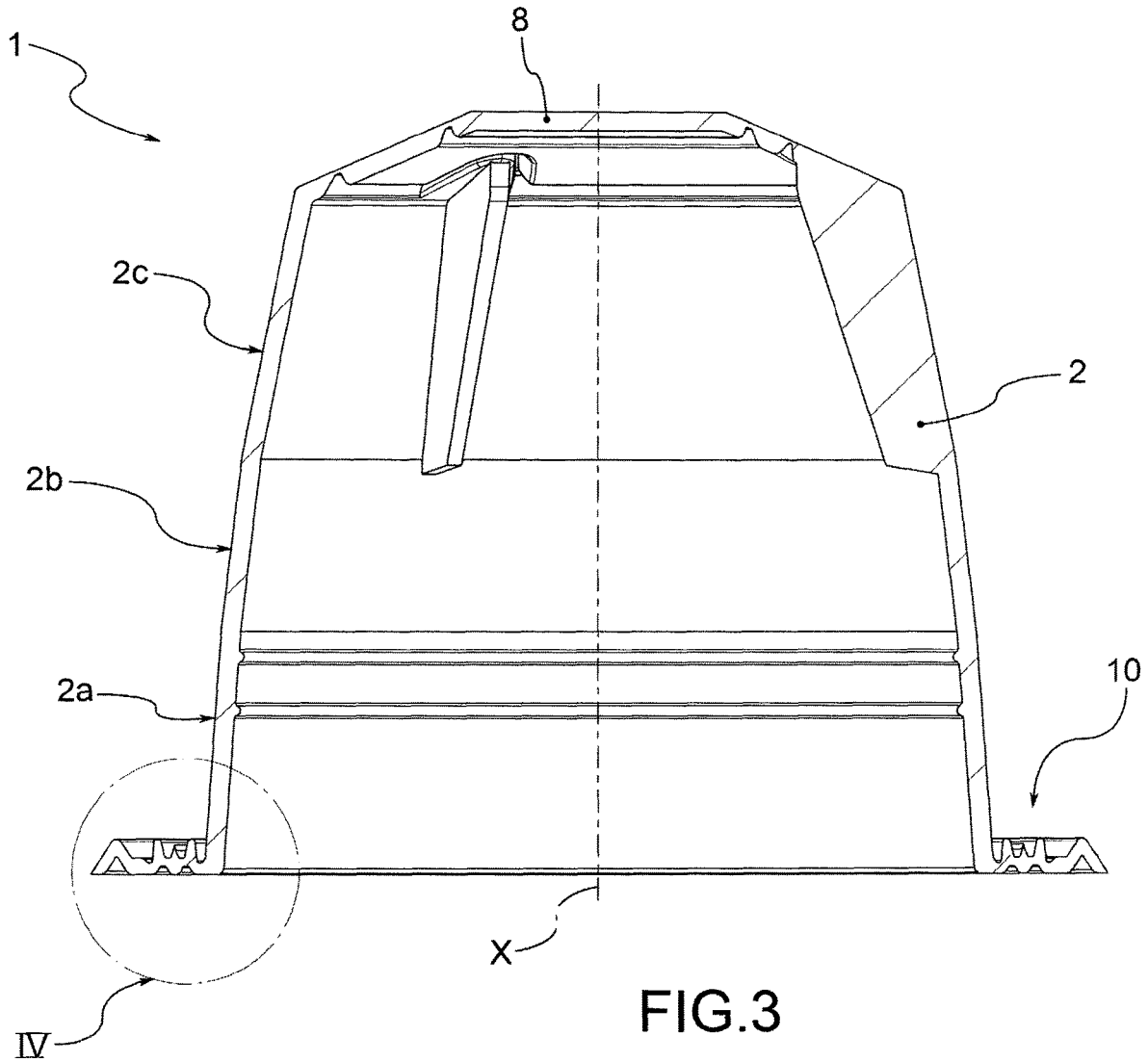
FIGS. 3, 7, 11 and 15 show a cross section of the capsule respectively of FIGS. 1, 5, 9 and 13.
Figure 4:
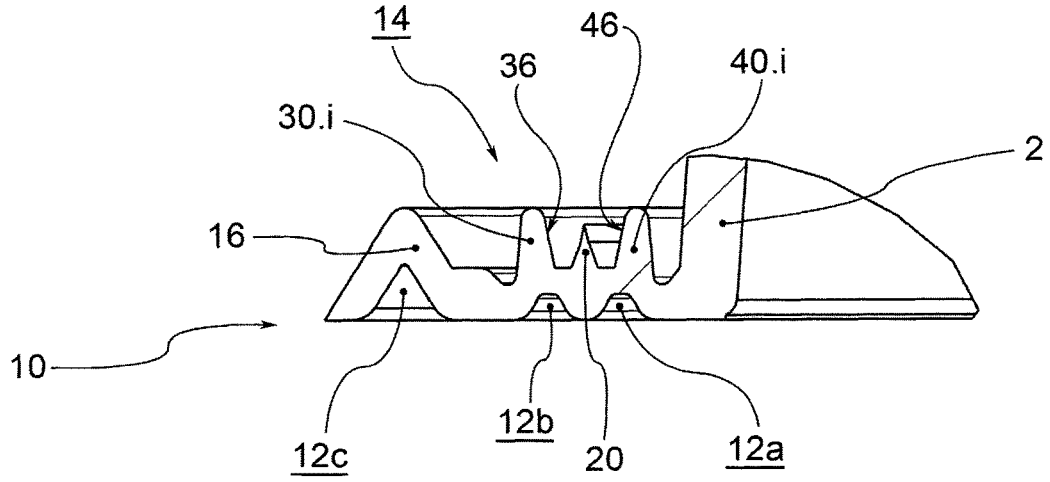
FIGS. 4, 8, 12 and 16 illustrate an enlargement of details IV, VII, XII and XVI respectively of FIGS. 3, 7, 11 and 15.

According to an embodiment, the internal gaps 42 are radially aligned to the external gaps 32; moreover, for example, the internal projections 40.*i* have equal angular extension of the external projections 30.*i* (FIG. 2).

Figure 6:
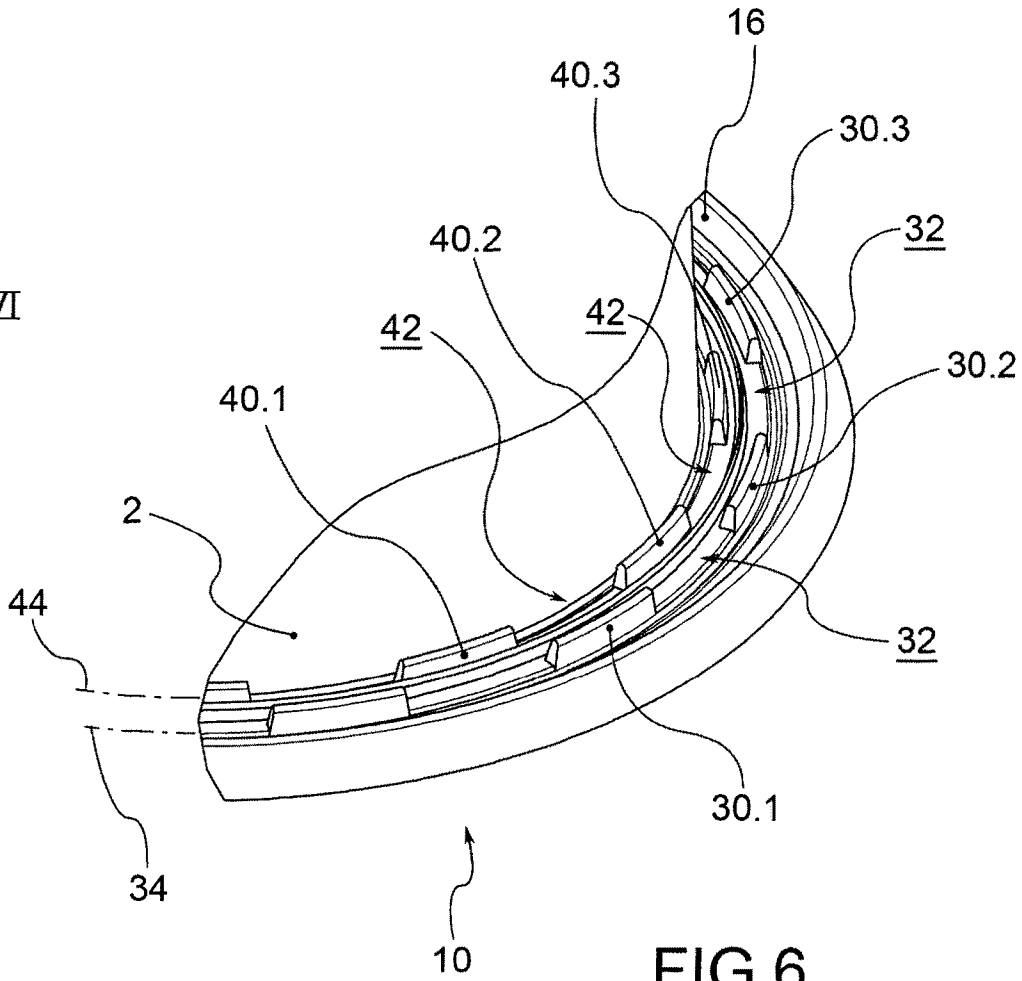

According to a further embodiment, the external gaps 32 are radially aligned with the internal projections 30.*i* and the internal gaps 42 are radially aligned with the external projections 40.1 (FIG. 6).

According to this embodiment, in any cross section obtained with a plane containing the central axis X of the cup, the sealing ring 20 is alongside or only on the from an external projection 30.*i* or only inside from an internal projection 40.*i*.

Preferably, according to this embodiment, between an internal projection 30.*i* and an external projection 40.*i* immediately following, there is no circumferential opening. According to a further variant, instead, between an internal projection 30.*i* and an external projection 40.*i* alongside said internal projection 30.*i*, there is realised a circumferential opening.

In addition, according to a preferred embodiment, the cup 1 comprises stiffening means suitable to structurally stiffen the centring projections and/or the sealing rings.

Preferably, said stiffening means comprise, for each centring projection 30.*i*,40.*i*, at least one fin 50 that unites the internal projection 30.*i* or the external projection 40.*i* with the sealing ring 20.

Preferably, for each centring projection 30.*i*,40.*i*, several fins 50 are provided, for example two, spaced circumferentially.

Figure 10:
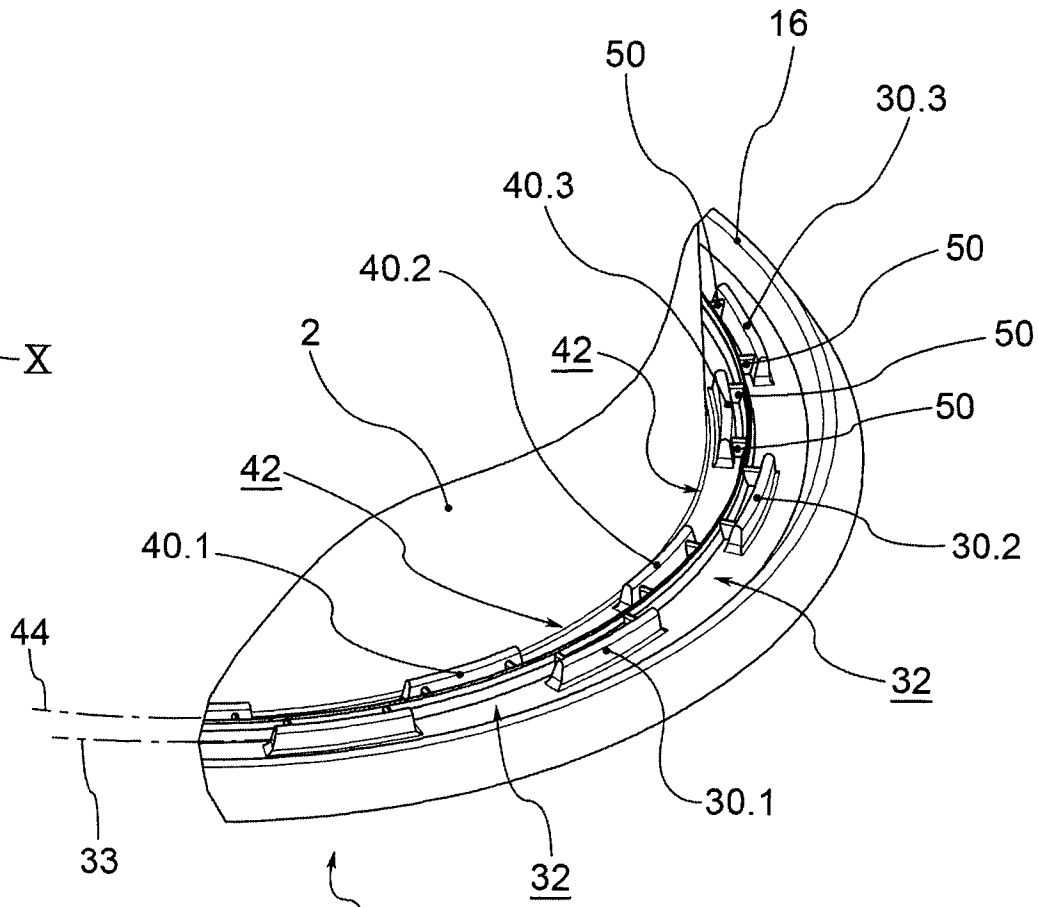
Figure 9:
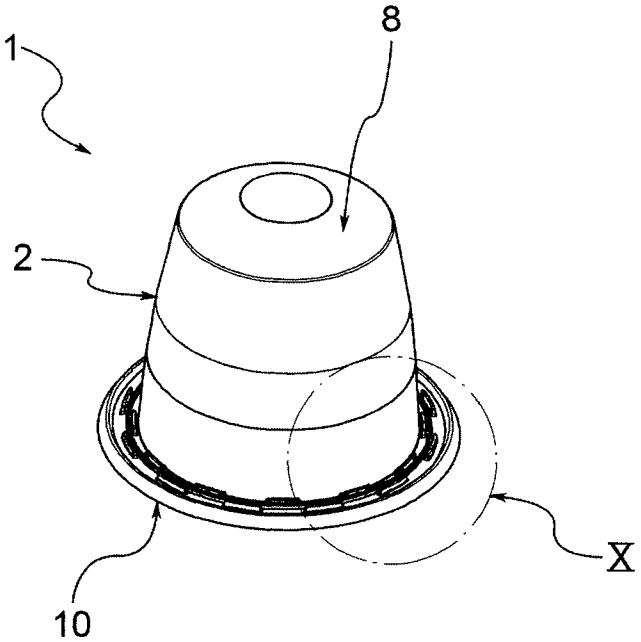
Figure 11:
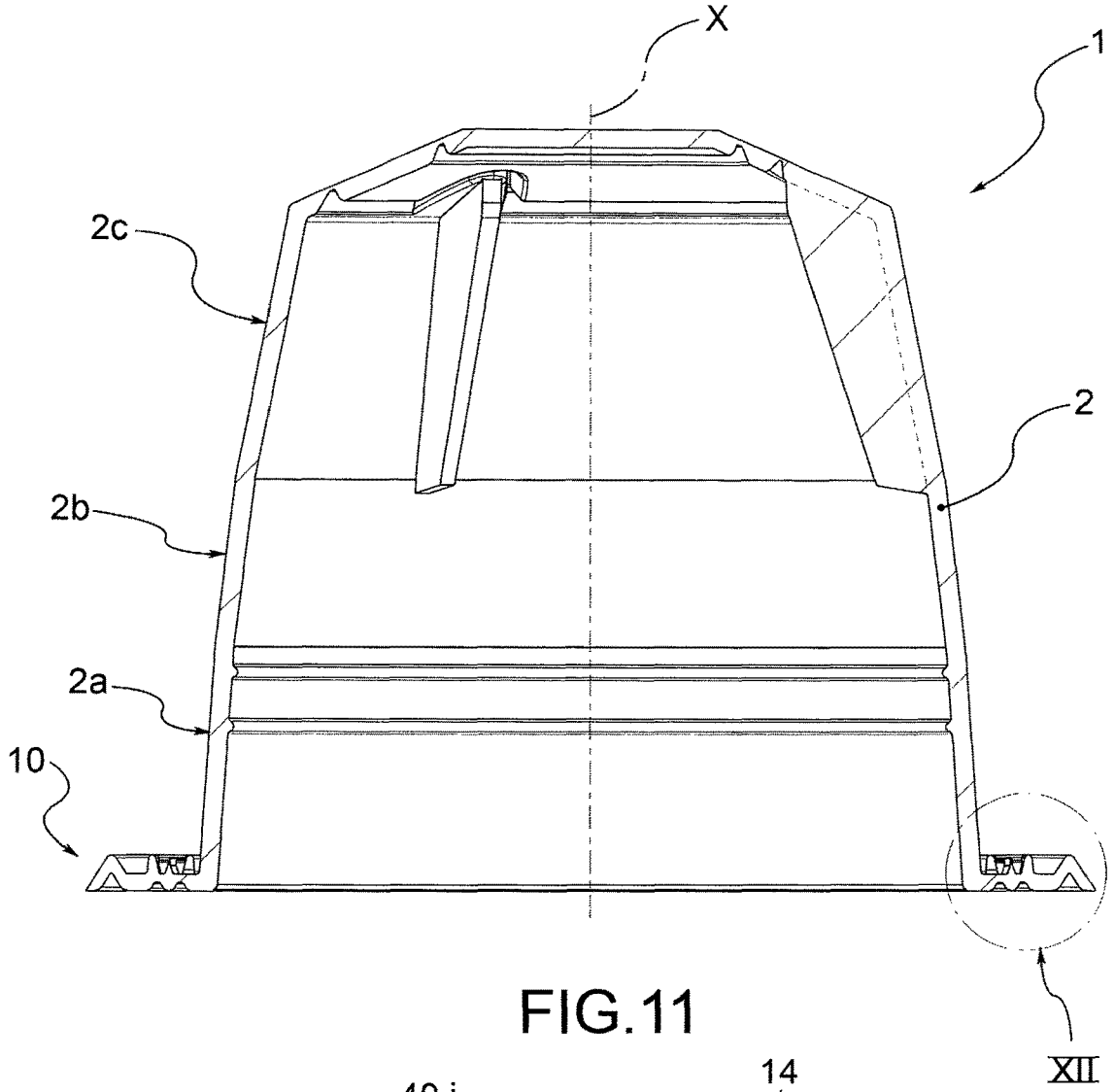
Figure 12:
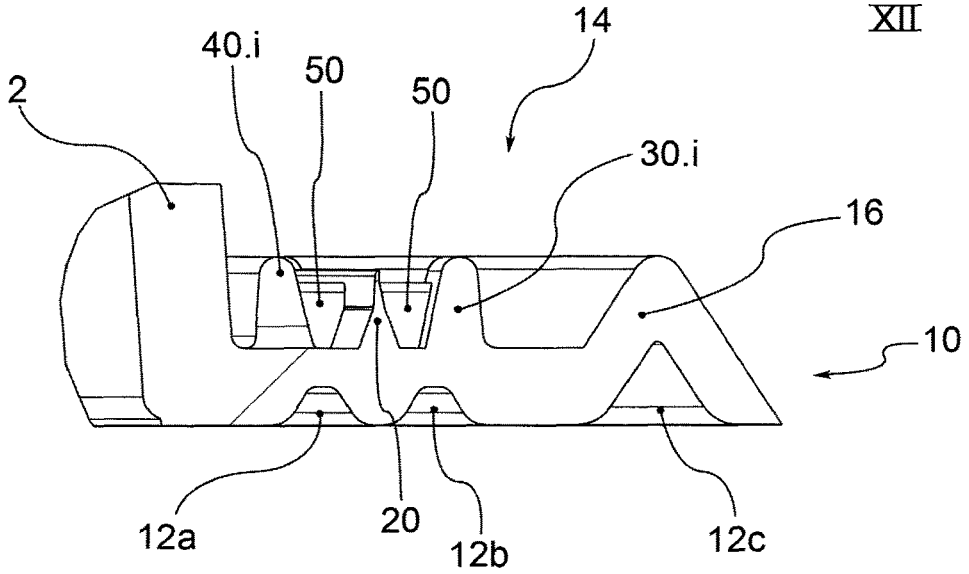

Preferably, the fins 50 have a radial arrangement, i.e., they have a median plane containing the central axis X of the cup 1 (FIG. 10).

Figure 14:
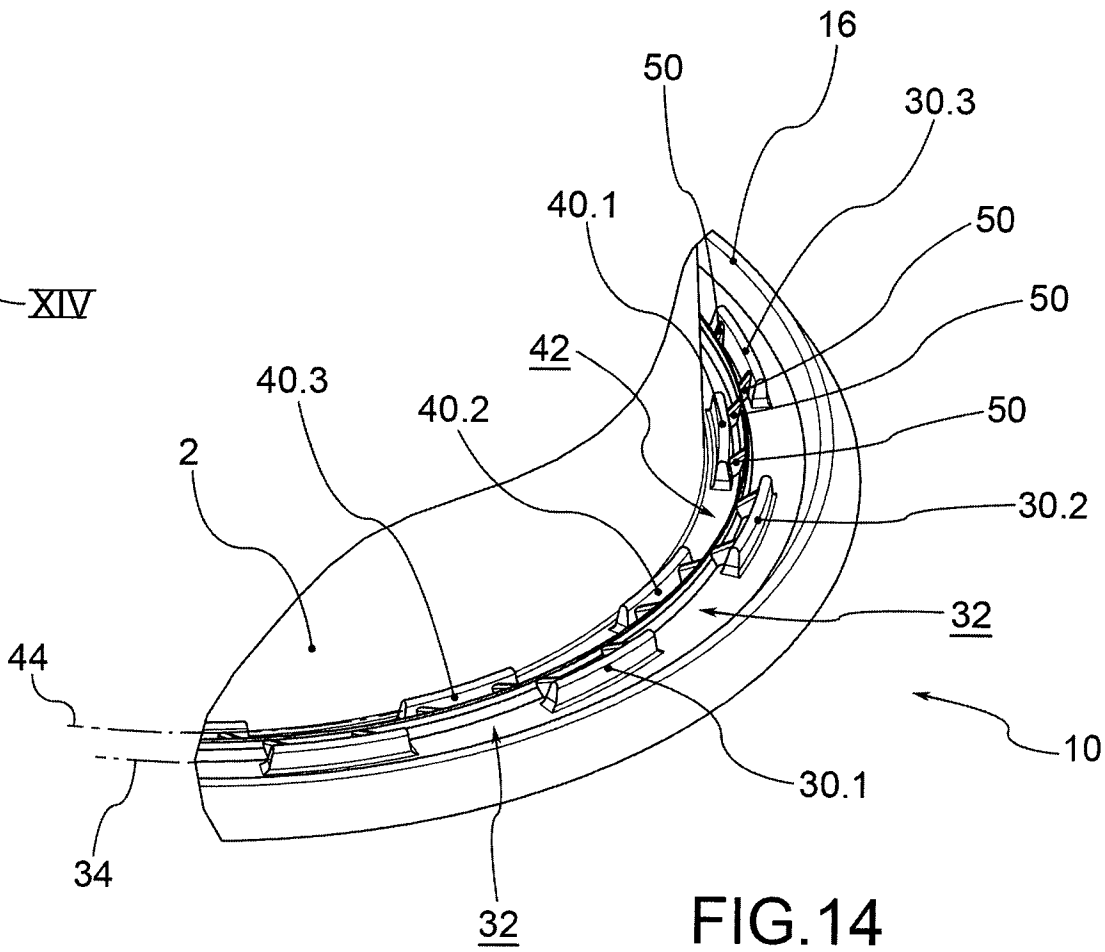
Figure 13:
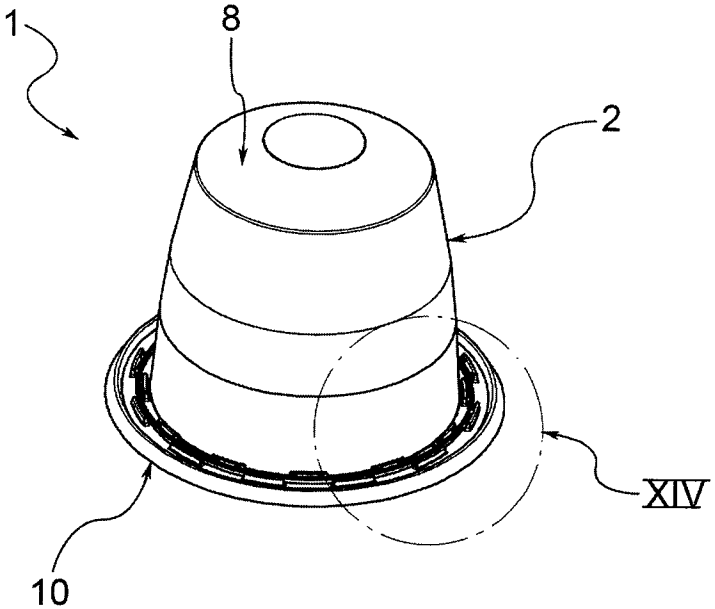
Figure 15:
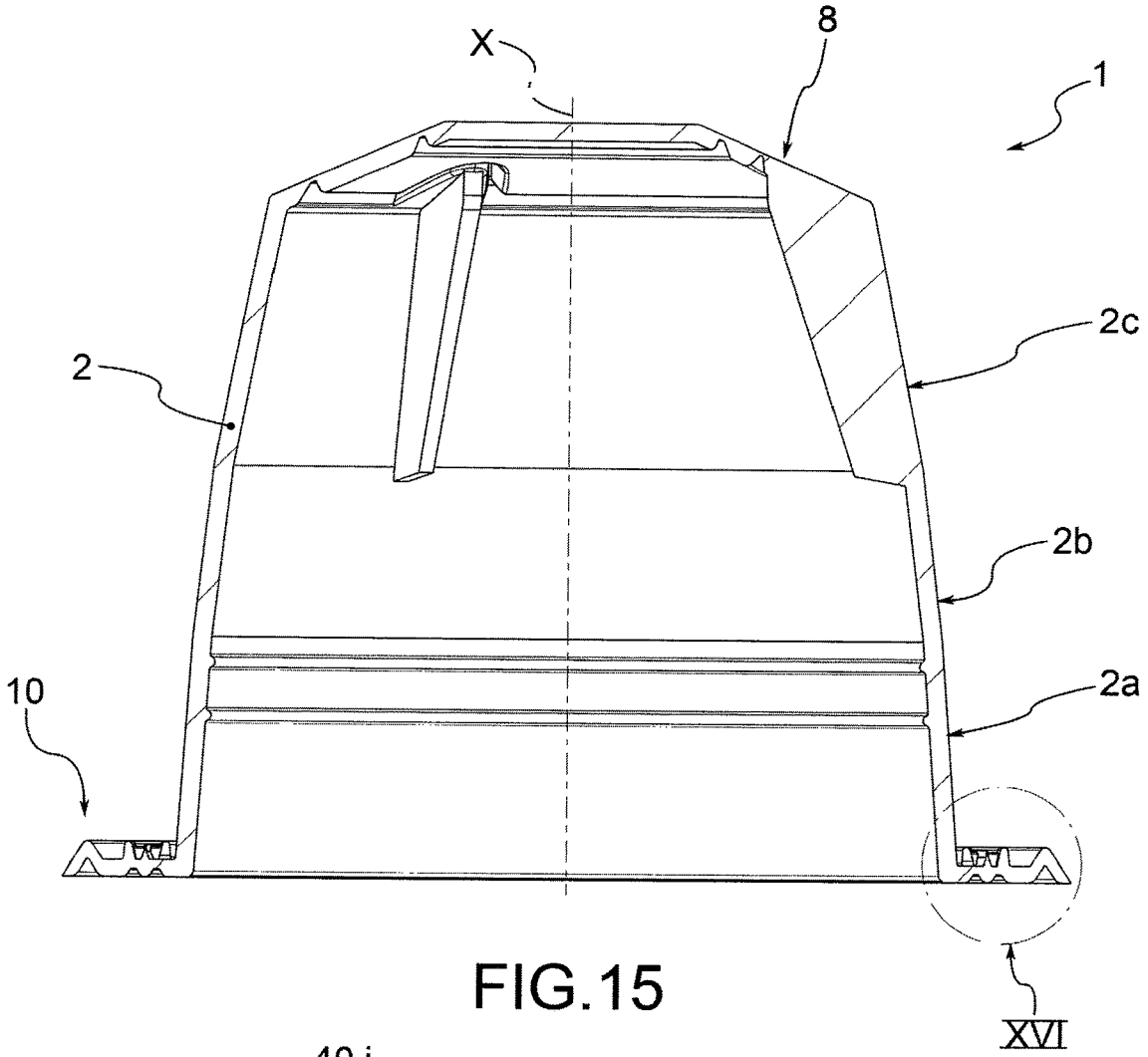
Figure 16:
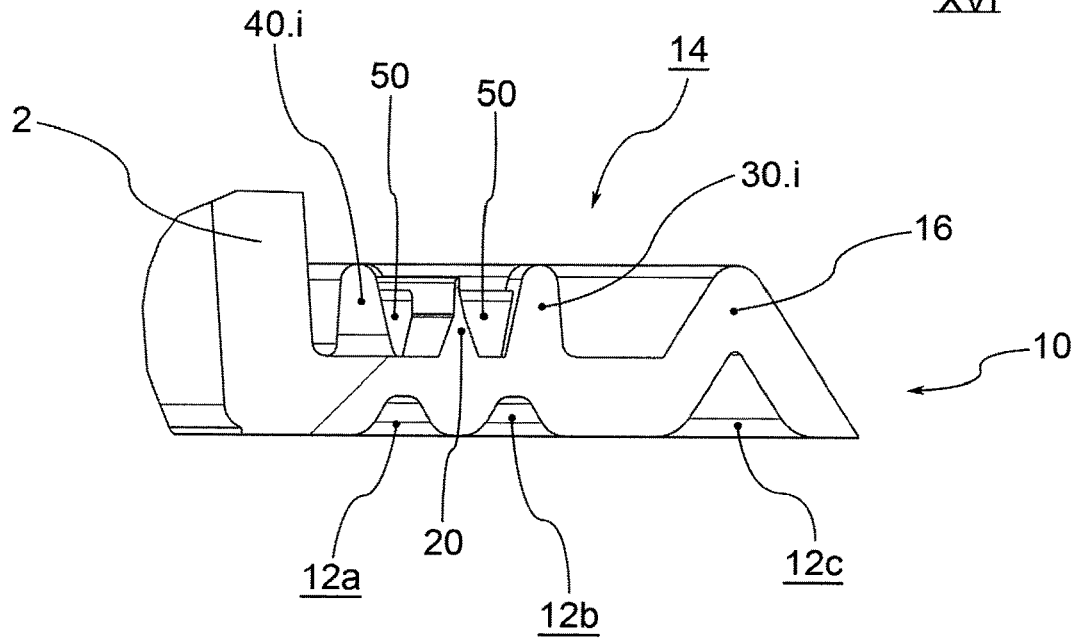

According to a further embodiment, the fins 50 have an arrangement inclined with respect to the radial direction (FIG. 14).

In addition, preferably, the fins 50 have a lower height than that of the sealing ring 20.

According to an embodiment variant (not shown), the fins have a height equal to that of the sealing ring.

Figure 5:
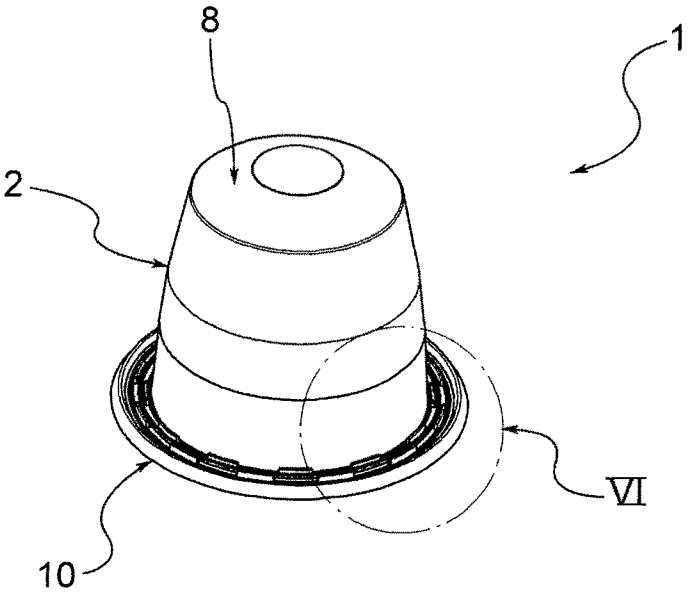
Figure 7:
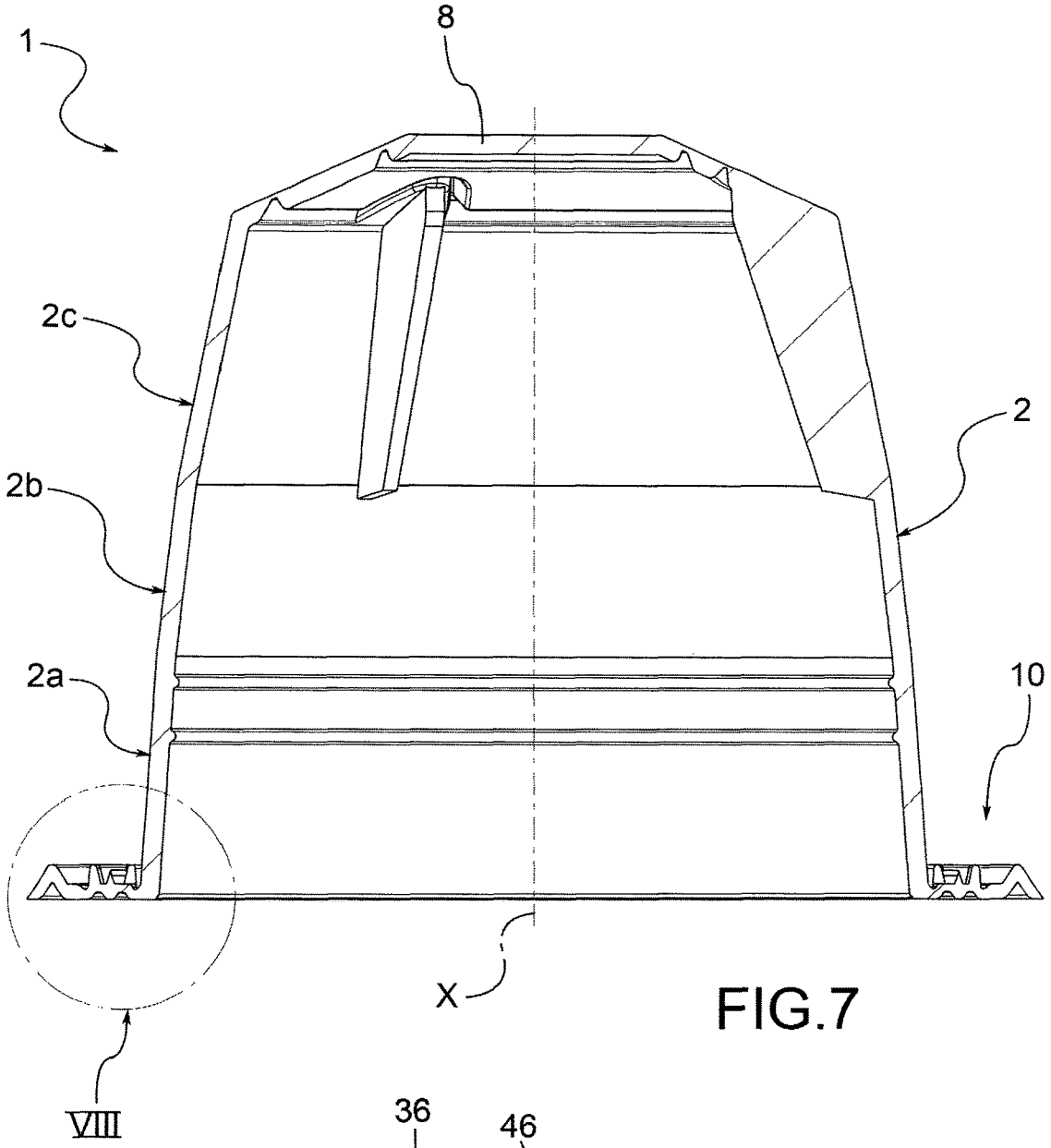
Figure 8:
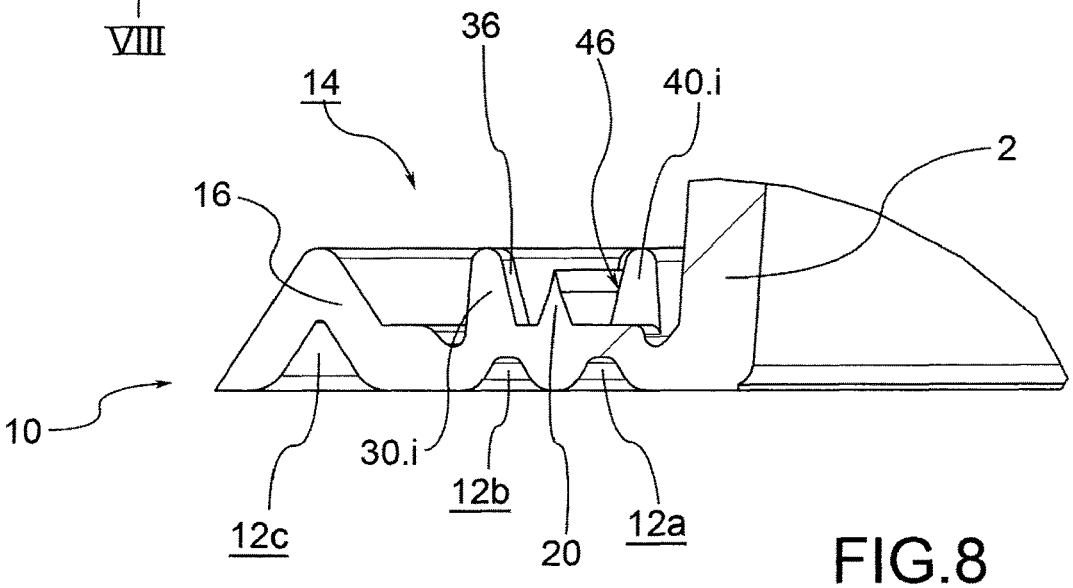
Figure 17:
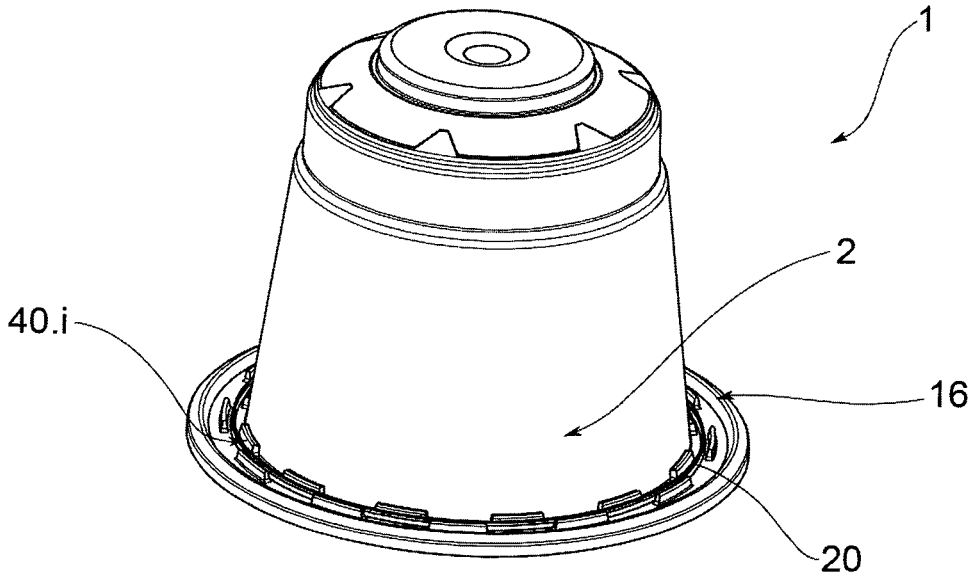
FIGS. 17 and 18 show respectively an axonometric view and an enlargement of detail XVII, of the capsule according to an embodiment variant similar to that of FIG. 5.
Figure 18:
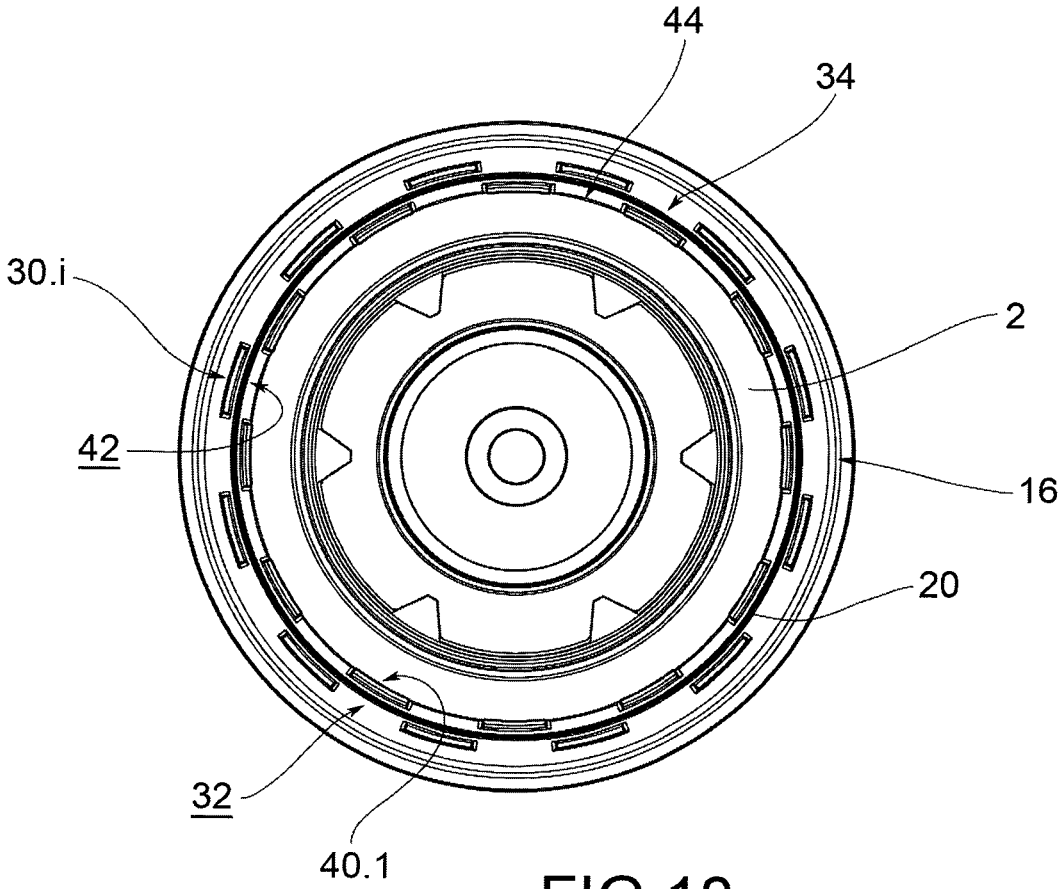

The embodiment variant of FIGS. 17 and 18 shows a capsule according to an embodiment variant similar to that of FIG. 5. According to this variant, the external gaps 32 are radially aligned with the internal projections 30.*i* and the internal gaps 42 are radially aligned with the external projections 40.1 (FIG. 18). Moreover, in this example, between an internal projection 30.*i* and an external projection 40.*i* alongside said internal projection 30.*i*, there is realised a circumferential opening.

As is evident from the top view, the centring means comprise a plurality of external centring projections 30.*i* (in FIG. 18, for a total of twelve) arranged aligned in succession along a single external circumferential path 34, and a plurality of internal centring ridges 40.*i* (in FIG. 18, for a total of twelve), arranged aligned in succession along a single internal circumferential path 44. In particular, the plurality of centring projections 30.*i*,40.*i* comprises a number of projections greater than two, preferably greater than four.

The internal centring projections 40.*i* are circumferentially staggered with respect to the external centring projections 30.*i*.

Furthermore, in this example, the internal centring projections 40.*i* are made adjacent, or contiguous, close to the annular cup wall 2.

Figure 19:
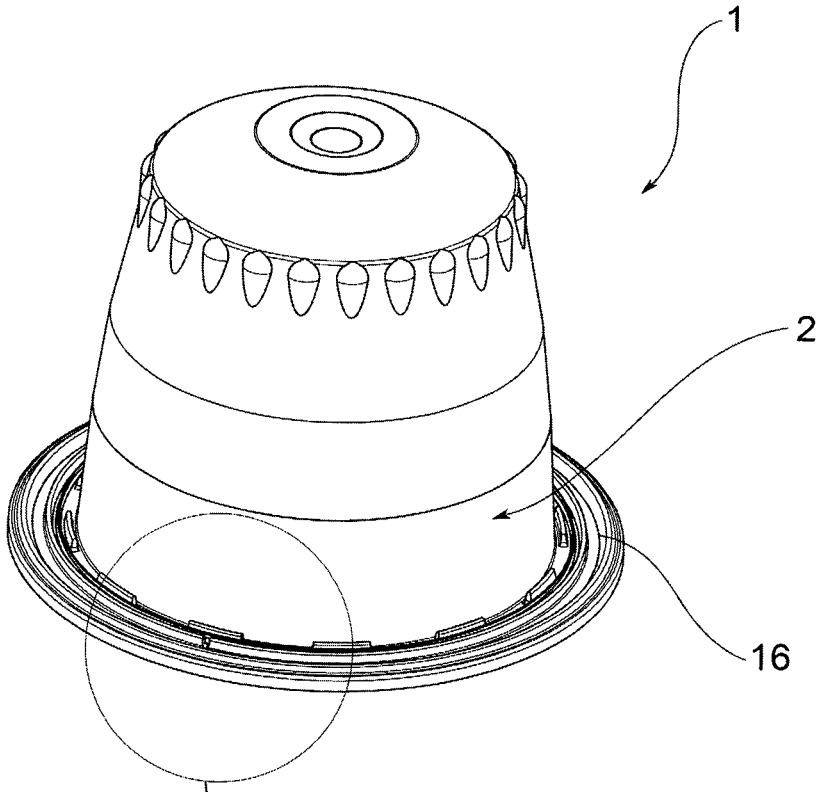
FIGS. 19, 20 and 21 show respectively an axonometric view, an enlargement of detail XIX and a top view of a capsule in a still further embodiment.
Figure 20:
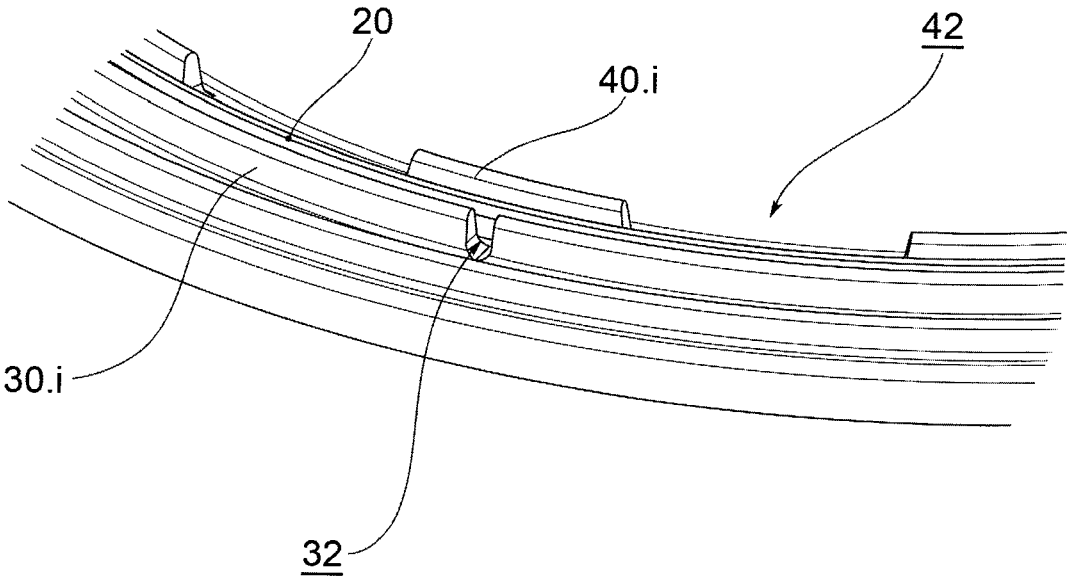
Figure 21:
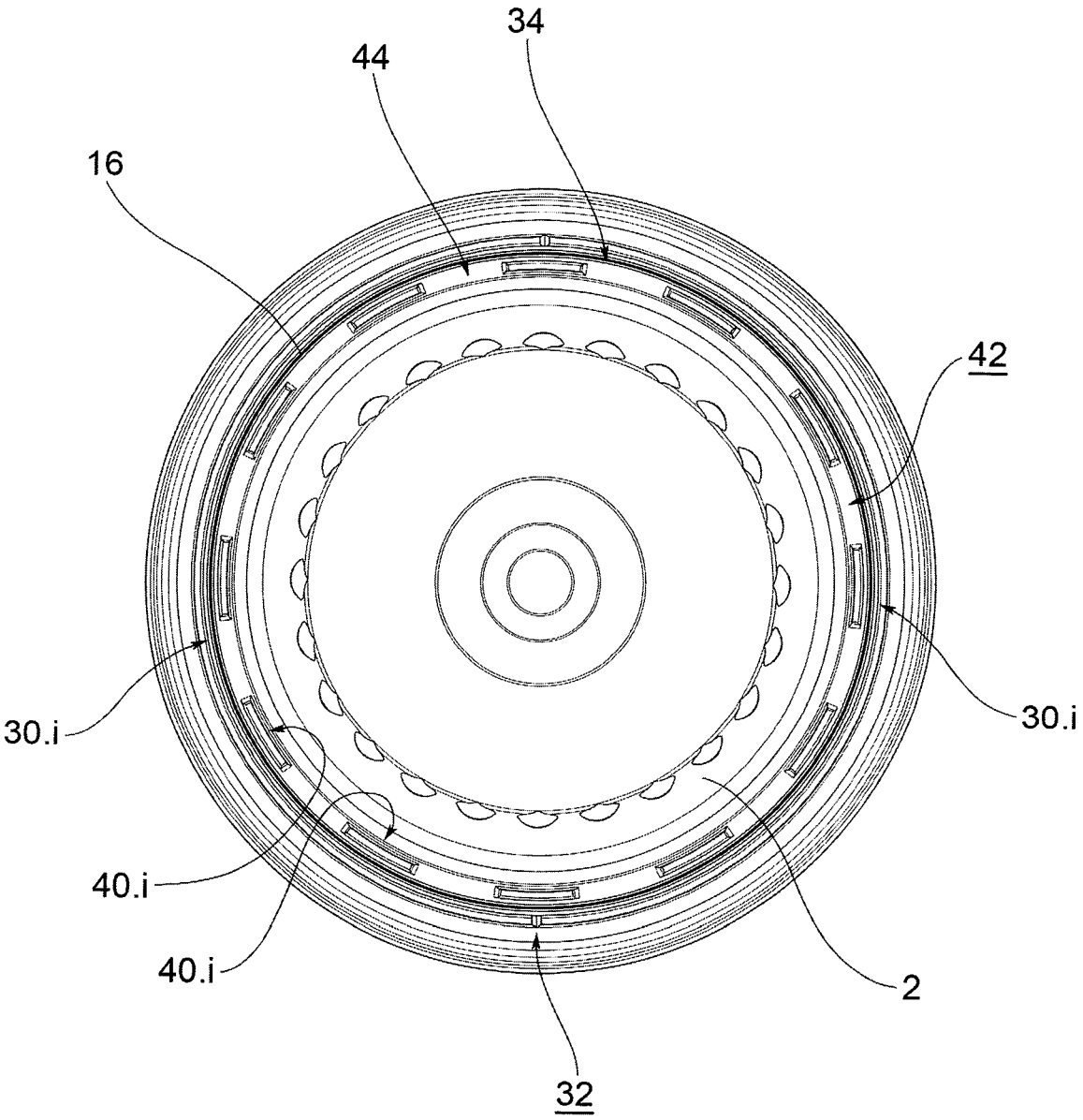

The embodiment variant of FIGS. 19 to 21 shows a capsule according to a further embodiment variant. According to this variant, the external gaps 32 are radially aligned with the internal projections 30.*i* and the internal gaps 42 are radially aligned with the external projections 40 (FIG. 20). Moreover, in this example, between an internal projection 30.*i* and an external projection 40.*i* alongside said internal projection 30.*i*, there is realised a circumferential opening.

As is evident from the top view, the centring means comprise only two external centring projections 30.*i* arranged aligned in succession along a single external circumferential path 34, and a plurality of internal centring ridges 40.*i* (in FIG. 18, for a total of twelve), arranged aligned in succession along a single internal circumferential path 44. In this example as well, the plurality of centring projections 40.*i* comprises a number projections greater than two, preferably greater than four.

Furthermore, in this example, the internal centring projections 40.*i* are spaced from the annular cup wall 2.

Figure 22:
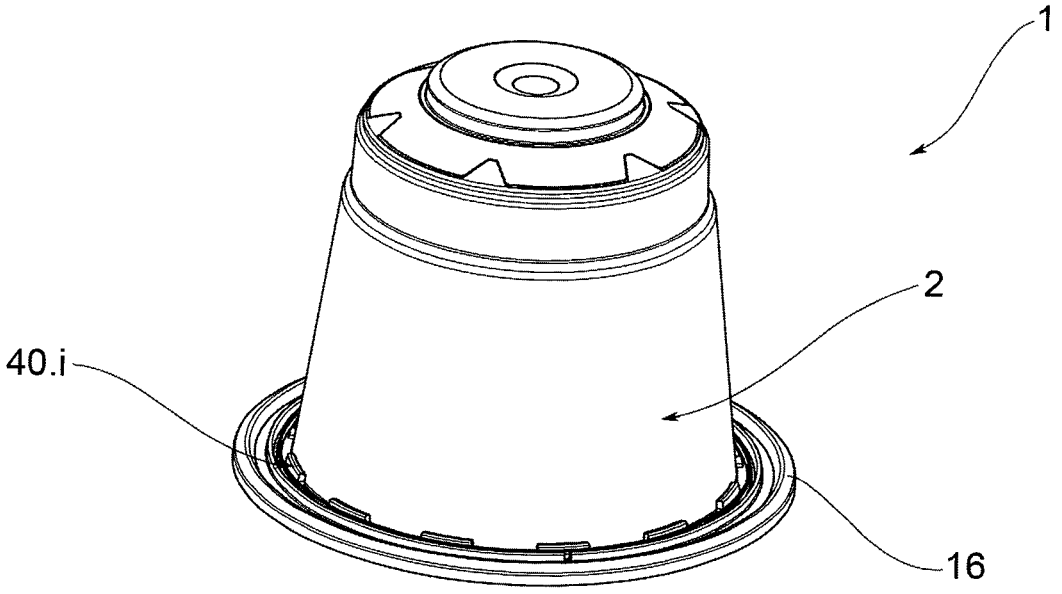
FIGS. 22 and 23 show respectively an axonometric view and an enlargement of detail XXII, of the capsule according to an embodiment variant similar to that of FIG. 19.
Figure 23:
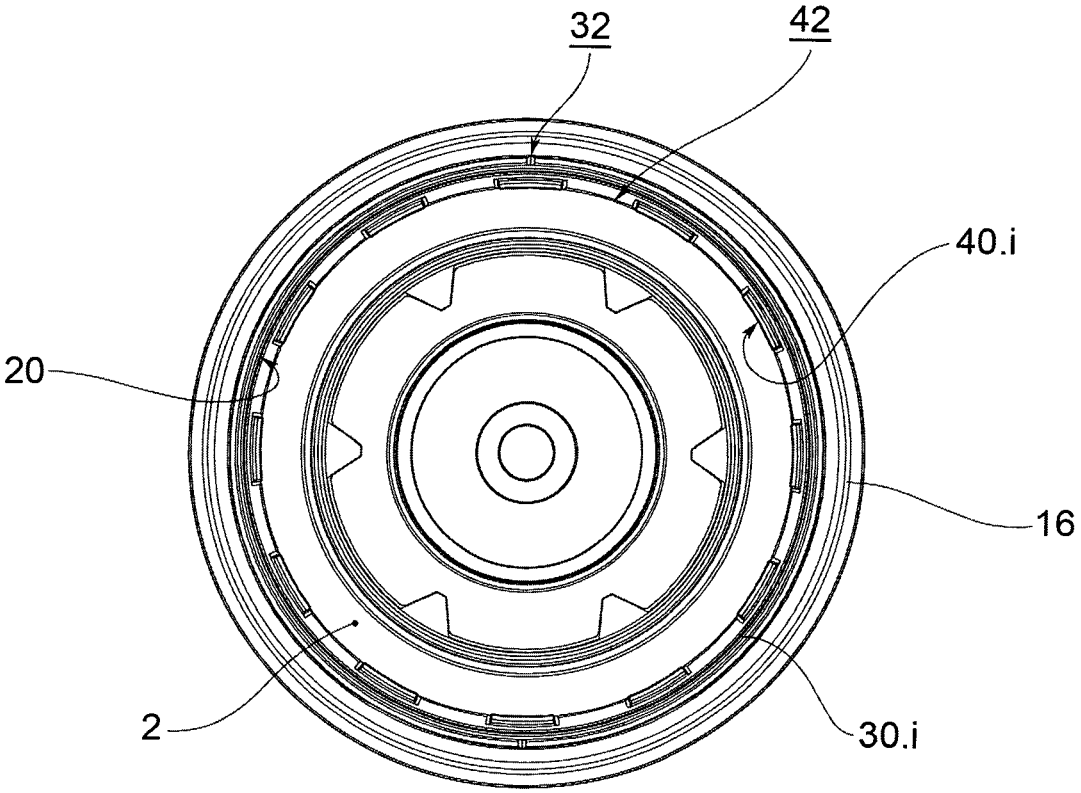

The embodiment variant of FIGS. 22 and 23 shows a capsule according to an embodiment variant similar to that of FIG. 19. However, in this example, the internal centring projections 40.*i* are made adjacent, or contiguous, close to the annular-cup wall 2.

In normal use, the capsule according to this invention is introduced into the compartment of the machine and, after activating the movement of the machine components, the front face 10*a* of the collar 10 is brought into abutment with the fixed wall of the compartment, while the rear face 10*b* is engages with the peripheral edge of the inner chamber.

After introducing the capsule into the compartment of the machine, it is very likely that the sealing ring is not perfectly coaxial with the peripheral edge.

However, while the peripheral edge approaches the sealing ring, if it is not coaxial with it, it will touch the centring projections (the external ones, internal ones, or both, depending on the disposition of the capsule).

This engagement leads to an adjustment of the disposition of the capsule, which results in a better centring of the peripheral edge with respect to the sealing ring.

During the engagement of the peripheral edge with the capsule, it is possible that an interference is created with an internal projection or with an external projection, which is overcome by the capsule according to the invention by virtue of the high flexibility of the centring projections obtained through their circumferential separation.

Additionally, during engagement, the formation of an optimum head seal is ensured, in the embodiments that provide for it, by the fins, which limit the tendency of the ring to bend towards the inside or towards the outside.

Innovatively, the capsule according to this invention overcomes the drawbacks mentioned above with reference to the known art, since it allows improving the centring of the collar with respect to the peripheral edge of the machine.

Advantageously, moreover, the centring system adopted by the invention limits the risk that a too high stiffness of the projections will create an interference with the peripheral edge that prevents the formation of the seal.

Moreover, according to a further advantageous aspect, the capsule limits the tendency of the ring to bend towards the inside or towards the outside and therefore allows obtaining an optimum seal with high repeatability.

It is clear that one skilled in the art, in order to meet contingent needs, may make changes to the capsule described above, all contained within the scope of protection defined by the following claims.

The invention claimed is:

1. A single-dose capsule for the preparation of coffee, infusions, decoctions or other hot beverages in a machine, comprising:

a cup provided with a collar having a front face and a rear face;

at least one sealing ring arranged on the rear face of the collar, which engages with a peripheral annular edge of an inner compartment of the machine to form a seal;

a plurality of centering projections, having a height equal to, or greater than, that of the sealing ring, and being arranged radially externally and/or internally with respect to the sealing ring, said projections being circumferentially separated by gaps and aligned in succession along a single circumferential path, wherein the external centring projections are arranged radially externally with respect to the sealing ring, circumferentially separated by external gaps and aligned in succession along a single external circumferential path and the internal centering projections are arranged radially internally with respect to the sealing ring, circumferentially separated by internal gaps and aligned in succession along a single internal circumferential path, and wherein the internal projections have the same angular extension as the external projections.

2. The single-dose capsule according to claim 1, wherein each centering projection has a circumferential trend.

3. The single-dose capsule according to claim 1, wherein the internal gaps are radially aligned to the external gaps.

4. The single-dose capsule according to claim 1, and wherein the external gaps are radially aligned with the internal projections and the internal gaps are radially aligned with the external projections.

5. The single-dose capsule according to claim 4, wherein the centering means comprises a plurality of external centering projections and a plurality of internal centering projections, and wherein the plurality of centering projections comprises a number of projections greater than two.

6. The single-dose capsule according to claim 4, wherein the internal centring projections are circumferentially staggered with respect to the external centering projections.

7. The single-dose capsule according to claim 4, wherein the centering means comprises two external centering projections and a plurality of internal centering projections, and wherein the external and internal centering projections comprises a number of projections greater than two.

8. The single-dose capsule according to claim 4 wherein the internal centering projections are made close to an annular cup wall.

9. The single-dose capsule according to claim 1, comprising stiffening means suitable to structurally stiffen the centering projections, and/or the sealing rings, and wherein said stiffening means comprise, for each centering projection, at least one fin that unites the projection with the sealing ring.

10. The single-dose capsule according to claim 9, wherein the fins have a radial disposition with respect to the radial direction.

11. The single-dose capsule according to claim 9, wherein the fins have a lower height than that of the sealing ring.

12. The single-dose capsule according to claim 1, wherein the cup, the sealing ring and the centering projections are made in one piece in plastic, optionally said plastic being polyethylene or polypropylene.

* * * * *